US005506473A

United States Patent [19]

Aucouturier et al.

[11] Patent Number: 5,506,473

[45] Date of Patent: Apr. 9, 1996

[54] ELECTRON GUN FOR PROVIDING ELECTRONS GROUPED IN SHORT PULSES

[75] Inventors: Jeanne Aucouturier, L'Hay les Roses; André Bensussan, Paris; Hubert Leboutet, St Cloud, all of France

[73] Assignee: Thomson-CSF, Puteaux, France

[21] Appl. No.: 706,674

[22] Filed: May 29, 1991

[30] Foreign Application Priority Data

Jun. 15, 1990 [FR] France ..... 90 07514

[51] Int. Cl.[6] ..... H01J 25/10

[52] U.S. Cl. ..... 315/5.43

[58] Field of Search ..... 315/5.43, 5.42, 315/5.41; 328/233

[56] References Cited

U.S. PATENT DOCUMENTS 2,565,708 8/1951 Warnecke et al. ..... 315/5.43
2,747,129 5/1956 Mayer ..... 315/5.43
3,454,818 7/1969 Soffer et al. ..... 315/5.41
3,769,599 10/1973 Leboutet et al. ..... 315/5.41

*Primary Examiner*—Theodore M. Blum
*Attorney, Agent, or Firm*—Oblon, Spivak, McClelland, Maier & Neustadt

[57] ABSTRACT

This gun comprises a cathode K, a grid G, and an anode A between which the applied voltages are radio-frequency voltages. The cathode is disposed on the central conductor of a coaxial cavity, facing said grid terminating said cavity. Said cavity is terminated at the other end by a short-circuit and includes a coaxial branch line so as to resonate at two frequencies $F_1$ and $F_2$ multiple of $f_0$, whose beating induces a radio-frequency grid-cathode voltage. Said grid terminates another coaxial cavity whose central conductor is hollow and whose end facing said grid forms the anode. said other coaxial cavity resonator is excited and resonates at a frequency $F_0$ multiple of $f_0$, which induces a radio-frequency anode-grid voltage.

A proper selection of the frequencies $F_0$, $F_1$, $F_2$ allows to obtain electrons bunches of very short duration.

17 Claims, 4 Drawing Sheets

ELECTRON GUN FOR PROVIDING ELECTRONS GROUPED IN SHORT PULSES

BACKGROUND OF THE INVENTION

The present invention relates to an electron gun for providing electrons grouped in short pulses of predetermined pulse repetition frequency $f_0$.

In many applications, it is necessary to provide electrons grouped in short bunches. This is in particular the case when it is desired to inject these electron bunches into accelerating systems of the high-energy linear type.

The conventional solutions use electron guns with a triode structure formed by an electron-emitting cathode, a grid and an anode, all aligned. The electrons are provided during the times where a gating voltage is applied to the grid, the anode and the cathode being supplied with DC voltages.

A major disadvantage of this approach is related to the gating of the grid during a very short time, for example shorter than a nanosecond. As a matter of fact, the presence of inevitable parasitic capacitances produces in the triggering circuits time constants which are difficult to decrease. If, in addition, as is the case in certain applications, it is desired to obtain electrons grouped in extremely short times, of about 10 to 100 picoseconds, it is necessary to effect a velocity modulation with an additional cavity resonator, which increases the complexity and the cost of the device.

SUMMARY OF THE INVENTION

A purpose of the present invention is to remedy these disadvantages thanks to a very simple solution allowing to eliminate the usual triggering circuits.

An object of the present invention is an electron gun in which all the voltages being used are radio-frequency voltages. By radio frequency, it is understood, in accordance with common usage, frequencies higher than a few tens of kilohertz.

According to the present invention, it is thus provided an electron gun to provide electrons grouped in short pulses of predetermined pulse repetition frequency $f_0$, said gun comprising a triode structure formed of an electron-emitting cathode, a grid and an anode, comprising first means to generate a radio-frequency cathode-grid voltage from at least one radio-frequency wave of frequency at least equal to said pulse repetition frequency $f_0$, and second means for generating a radio-frequency anode-grid voltage from a first radio-frequency wave of frequency $F_0=k_0f_0$, where $k_0$ is an integer equal to or greater than 1.

BRIEF DESCRIPTION OF THE DRAWINGS

The present invention will be better understood and other features and advantages will become apparent from the following detailed description of a preferred embodiment given as a non-limitative example with reference to the accompanying drawings, in which.

DESCRIPTION OF THE PREFERRED EMBODIMENT

Figure 1:
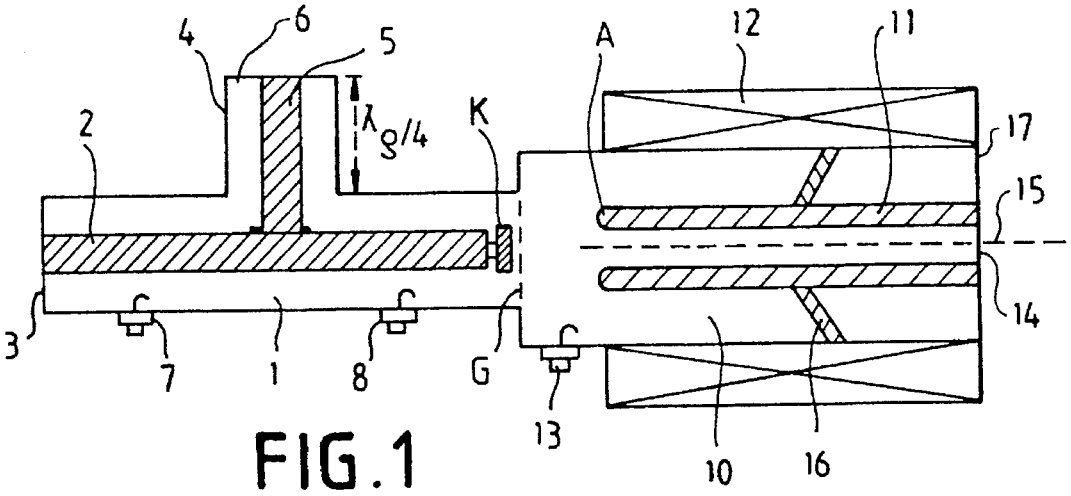
FIG. 1 is a schematic diagram of an electron gun according to the present invention without its power supply device.

Referring to FIG. 1, a schematic of the structure of an electron gun according to the present invention is shown.

The purpose of this gun is to provide electrons grouped in short pulses with a pulse repetition frequency $f_0$.

This gun comprises in a known manner an electron-emitting cathode K, a grid G and an anode A.

Instead of applying to the cathode and to the anode DC voltages, and to the grid gating pulses of short duration, according to the invention there provided to apply between the grid and the cathode, for one thing, and between the grid and the anode, for another, radio-frequency AC voltages. To this end, a first coaxial cavity resonator 1 including a central conductor 2 is provided. This cavity resonator is terminated at one end by a short-circuit 3 and is terminated at the other end by a cathode-grid capacitance KG, the grid G delimiting the cavity resonator 1, and the cathode K being carried at the end of the central conductor 2 facing the grid G. On the cavity 1, a coaxial branch line 4 with a central conductor 5 is provided. This branch line is terminated by a short-circuit 6 disposed so that the length of the branch line is equal to $\lambda g_1/4$, where $\lambda g_1$ is the wavelength in the coaxial cavity resonator 1 corresponding to a frequency $F_1=k_1f_0$ at which the cavity 1 is designed to resonate (as a function of its size and of the capacitance KG), $k_1$ being an integer equal to or greater than 1. At this frequency, the branch line 4 produces an infinite impedance on the cavity resonator 1 and consequently does not affect it. On the other hand, this branch line allows to have the cavity resonator 1 resonate at a second frequency $F_2=k_2f_0$, where $k_2$ is an integer greater than 1 such that $k_2=pk_1$, with p being an integer greater than 1.

For example, iF the branch line 4 is located substantially in the middle of the cavity resonator 1 and if it is assumed that p=2, the cavity resonator 1 will resonate at the frequency $F_1$ and at the frequency $F_2$, which is twice $F_1$, the branch line 4 producing at the frequency $F_2$ a short-circuit in the coaxial structure 1 due to its length equal to $\lambda g_2/2$.

The excitation waves with radio frequencies F1 and F2 are applied to the cavity 1 through excitation inputs 7 and 8.

Thus, there is obtained in the cavity 1 a radio frequency wave resulting from the beating of the waves of frequencies $F_1$ and $F_2$ and inducing a radio-frequency voltage between the cathode and the grid.

In a similar manner, a second coaxial cavity resonator 10 including a central conductor 11 is provided. This cavity resonator 10 is terminated at one end by a short-circuit 17 and is terminated at the other end by a grid-anode capacitance GA, the grid G delimiting the cavity 10, and the anode A being formed by the end of the central conductor 11 facing the grid G. The central conductor is comprised of a hollow cylinder whose inner space will allow the passage of the electron bunches emitted along the axis 15 of the assembly, as will be seen below. The characteristics of the cavity resonator 10 and the capacitance GA are determined so that the cavity 10 resonates at a frequency $F_0=k_0F_0$, where $k_0$ is an integer equal to or greater than 1.

The exciting wave at the radio frequency $F_0$ is applied to the cavity resonator 10 through an excitation input 13.

There is thus obtained in the cavity resonator 10 a radio-frequency wave at the frequency $F_0$ which induces a radio-frequency voltage between the grid and the anode.

Dielectric supports 16 may be provided to ensure a better supporting and centering of the central conductor 11. Furthermore, there is provided at the end of the inner space of the central conductor 11 a window 14 for the passage of the electrons.

Finally, a solenoid 12 surrounds the cavity resonator 10 over the length of the central conductor 11 to focuse the electrons along the axis 15 and thus form a drift space within this conductor.

Figure 3:
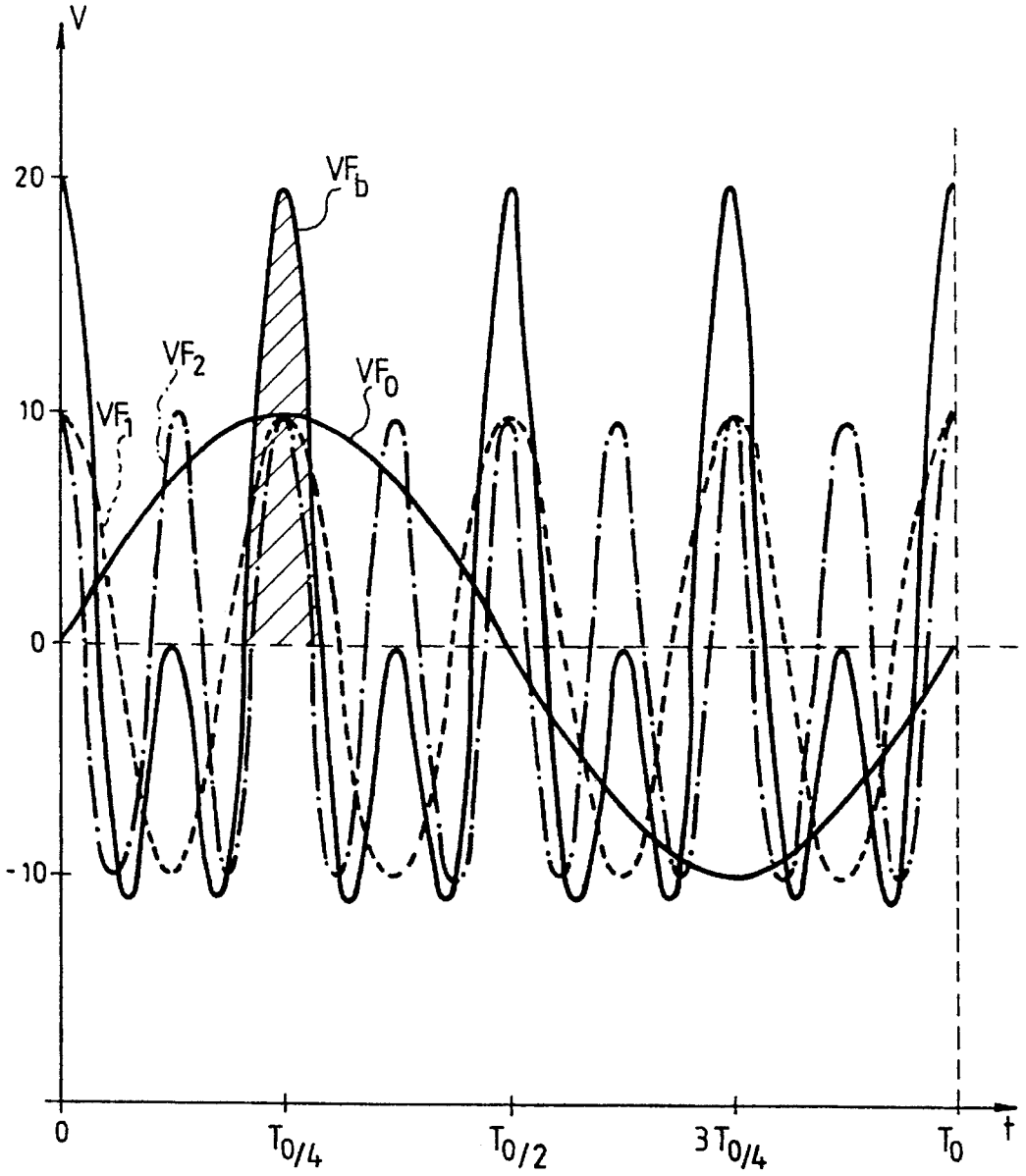
FIG. 3 shows curves representing the various voltages as a function of time for an example of selected frequencies.

The operation of the device will be better understood by means of the curves of FIG. 3 which correspond to an example in which the following values have been selected:

$$k_0=1\ (F_0=f_0),\ k_1=4\ (F_1=4f_0)$$

and $$k_2=8\ (p=2,\ F_2=8f_0).$$

In the diagram of FIG. 3, the voltages V are shown as a function of time, $T_0$ being the repetition period of the electron bunches ($T_0=1/f_0$). The curve $VF_0$ represents the anode-grid voltage. The curve $VF_b$ represents the grid-cathode voltage resulting from the beating of the two frequencies $F_1$ and $F_2$ represented in FIG. 3 by the curves $VF_1$ and $VF_2$ assuming that the amplitudes of the two waves are equal.

The current of electrons passes only when the grid-cathode voltage $VF_b$ and the anode-grid voltage $VF_0$ are simultaneously positive. It should be noted here that the amplitude ratio of these two voltages is absolutely not reproduced in the Figure to allow their representation in a single diagram. For example, the power injected into the cavity 10 may be of about 30 kW, which corresponds to voltages of a few tens to about one hundred kilovolts, while the powers injected into the cavity 1 may be of about 50 W each, which corresponds to voltages of a few hundred volts.

Thus, in FIG. 3, the electron current will pass only during the hatched positive peak of $VF_b$. The other peaks of $VF_b$ will either produce only a very little accelerated current of electrons, easily eliminated, corresponding to a substantially zero value of $VF_0$, or will give no current of electrons since the latter will be blocked by a very negative anode-grid voltage $VF_0$. Thus, in each period of the voltage $VF_0$, at the frequency $f_0$, a bunch of electrons will pass only for a short time corresponding to the width of the peak of $VF_0$.

For example, if a Frequency $F_0$ of 62.5 MHz, that is a period $T_0$=16 ns, is selected, the current of electrons will pass only For 1 ns, when the voltage $VF_0$ is maximum.

A very simple means is thus available for obtaining a pulse of 1-ns duration containing charges of about 4 nanocoulombs, For example, with a cathode delivering 4 amperes.

Figure 2:
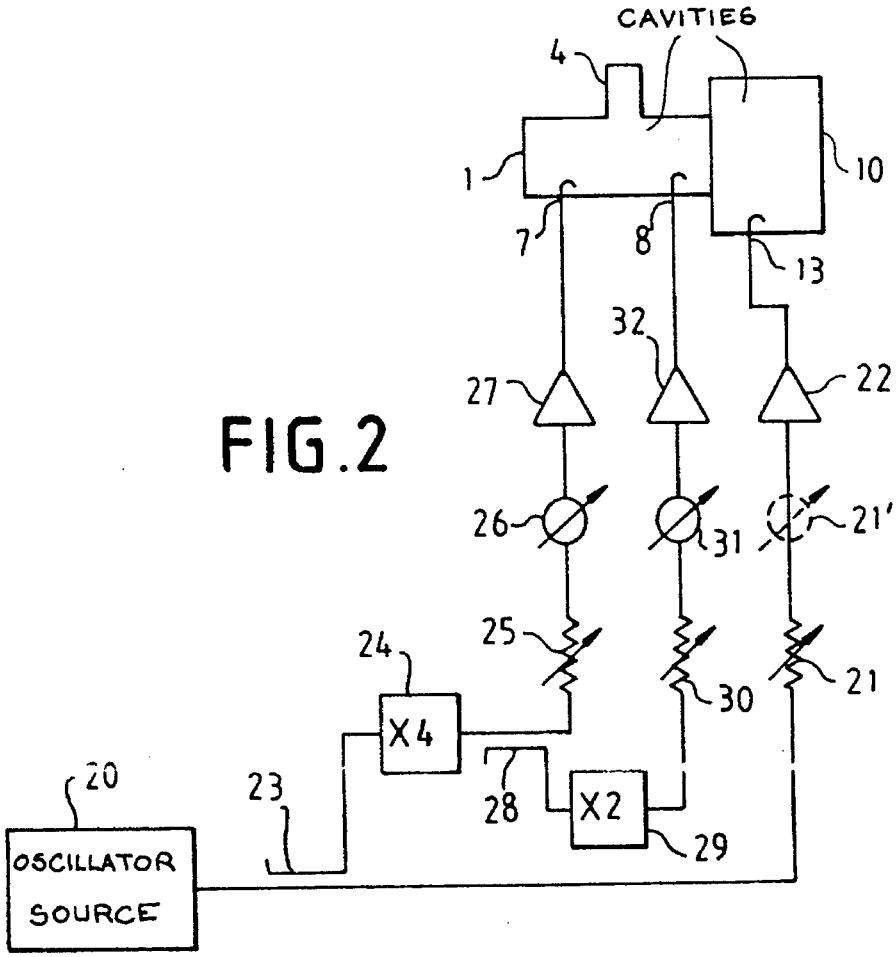
FIG. 2 is a block diagram of the electron gun according to the invention including the power supply circuits.

Power supply to the cavity resonators 1 and 10 can easily be implemented, for example by a circuit such as that of FIG. 2.

In this Figure, an oscillator source 20 provides directly a wave at the frequency $F_0=F_0$ which is applied to the excitation input 13 of the cavity 10 after passing through an amplitude adjusting device 21, possibly in a phase adjusting device 21', although this is not indispensable in every case, and an amplifier 22 for the signal applied to the input 13 to have the desired phase and amplitude.

Furthermore, a coupler 23 allows to tap a portion of the energy provided by the source 20 to send it to the inputs 7 and 8 of the cavity 1. This tapped energy is sent, for one thing, to the input 7 after passing through a frequency multiplier, multiplying here by 4, to obtain the frequency $F_1=4F_0$, through an amplitude adjusting device 25, a phase adjusting device 26, and an amplifier 27.

Finally, a coupler 28 taps a portion of the energy the output of the frequency multiplier 24 to send it to the input 8 after passing through a frequency multiplier 29, multiplying here by 2, to obtain the frequency $F_2=8f_0$, through an amplitude adjusting device 30, a phase adjusting device 31, and an amplifier 32.

The advantage of providing a single power supply source 20 is that it is not necessary to use complex circuits for feedback control of the phase and frequency of the various radio-frequency waves being used.

Figure 4:
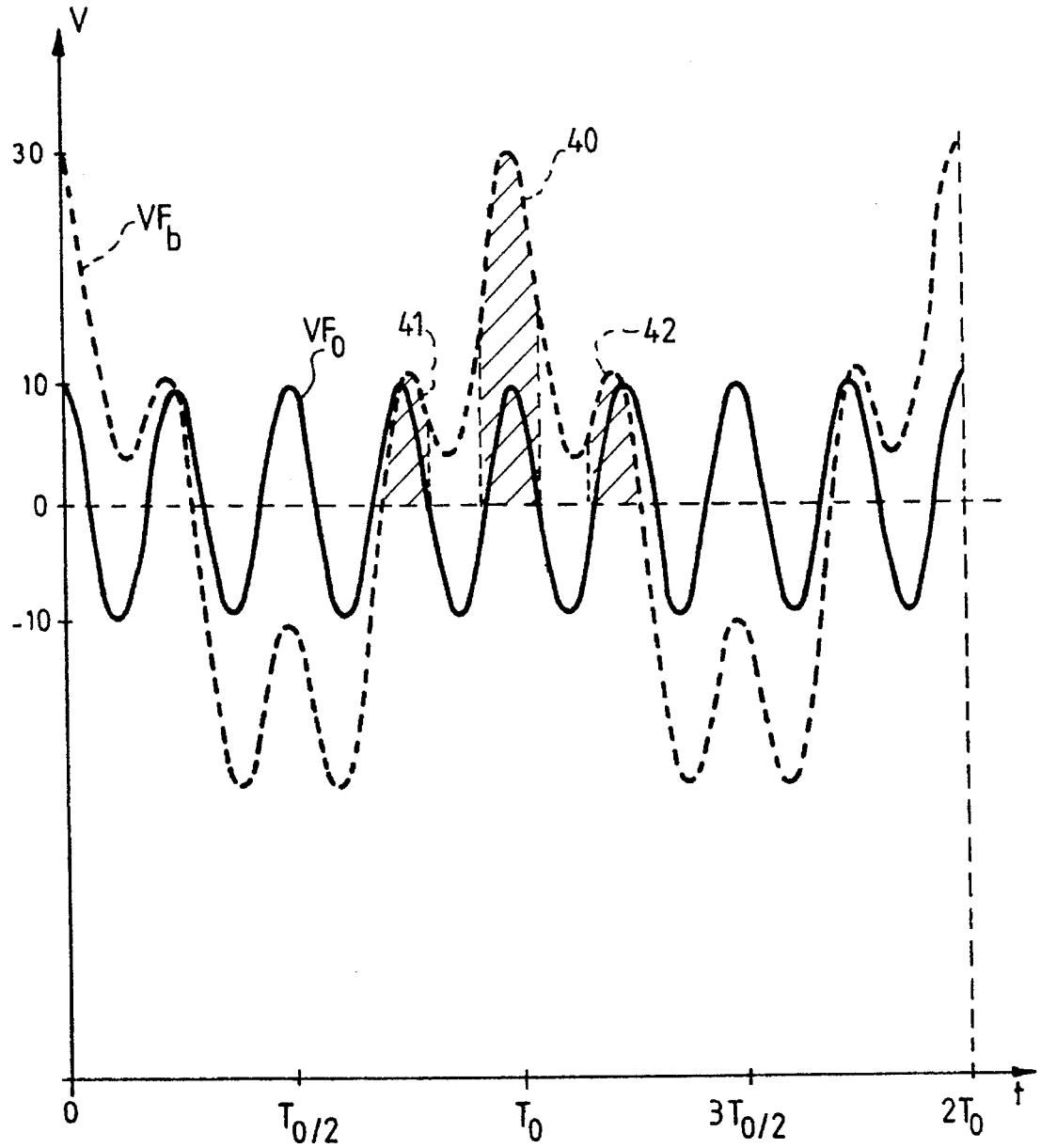
FIG. 4 shows similar curves for another set of frequencies.

Referring to FIG. 4, there are shown curves corresponding to another selection of frequencies which allows to better appreciate the various possible solutions.

In the case of FIG. 4, the values $k_0=4$ (hence $F_0=4f_0$), $k_1=1$ (hence $F_1=f_0$) and $k_2=4$ (hence $F_2=4f_0$) have been selected. The same curves would be obtained if, for reasons of ease of implementation of the various coaxial structures and supply circuits, frequencies multiple of these values, for example $F_0=8f_0$, $F_1=2f_0$ and $F_2=8f_0$, had been selected.

In the example of FIG. 4, it has been chosen to excite a wave at the frequency $F_2$ with an amplitude half that of the wave at the frequency $F_1$.

It can be seen that there is effectively obtained a main peak 40 of the curve $VF_b$ whose hachured portion corresponds to the passage of an electron beam and which repeats at the desired frequency $f_0$. But here this peak is flanked by secondary peaks 41 and 42 of the curve VFb, which also give rise to a passage of an electron beam in their hachured portion coinciding with a positive anode-grid voltage. These secondary beams are undesired. Moreover, the main electcon beam corresponding to the pic 40 is wider that in the case of FIG. 3. If nonetheless this solution illustrated in FIG. 4 is chosen for other reasons, it is possible to eliminate the effect of the secondary peaks by applying a DC additional bias to the grid G, which shifts the levels of curve $VF_b$.

Furthermore, this FIG. 4 allows to illustrate that it is possible to decrease the relative amplitude of the secondary peaks with respect to the main peak by selecting a higher ratio between the amplitudes of the waves at the frequencies $F_1$ and $F_2$.

When considering FIG. 3, the reason can also be seen for which it has been chosen to create a beat between two frequencies $F_1$ and $F_2$ in the cathode-grid cavity 1. There are thus obtained narrower peaks of the voltage $VF_b$, hence electrons grouped in a shorter pulse than if only the frequency $F_1$ had been used, while substantially reducing the emission of undesired electrons.

The selected values corresponding to FIG. 3 represent an interesting tradeoff.

Figure 5:
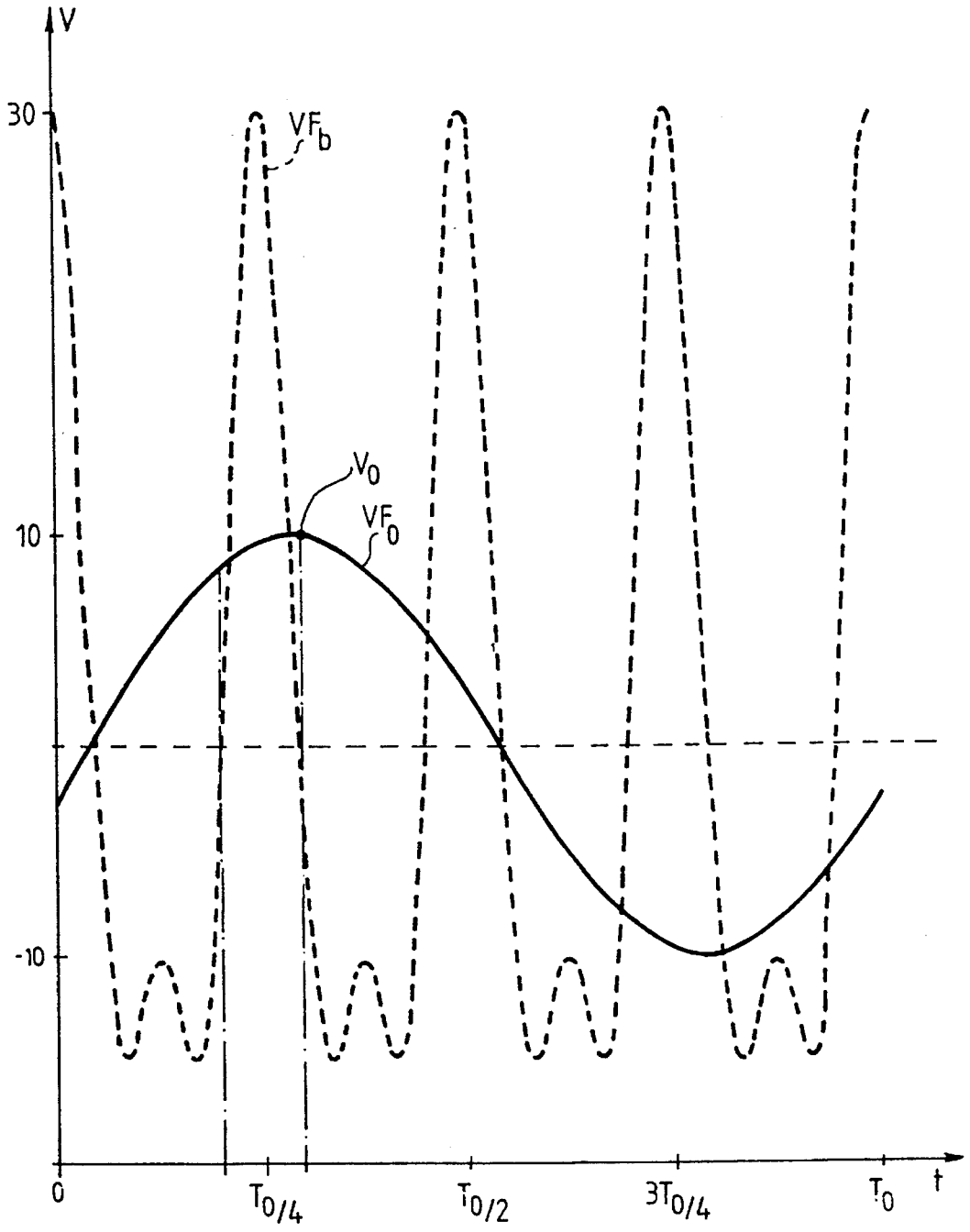
FIG. 5 shows the curves of FIG. 3 for an optimized embodiment.

Referring to FIG. 5, another important aspect of the present invention is shown. In this FIG. 5, there are shown the curves $VF_b$ and $VF_0$ corresponding to the same selection of frequencies as in FIG. 3, only the amplitude ratio at the frequencies $F_1$ and $F_2$ passing from 1 to 2 by simple way of example.

The significant difference with FIG. 3 is that the voltage $VF_b$ is phase-shifted with respect to the voltage $VF_0$ by a quantity equal to half the phase width of the electron bunch at the anode, i.e., substantially half the width of the peak of $VF_b$ (this width is here of about 22°). In this case, the first electron will pass the anode when an anode-grid voltage substantially equal to $V_0 \cos 22°$ is applied, where $V_0$ is the maximum value of the anode-grid voltage $VF_0$. As the electrons pass, the anode-grid voltage accelerating these electrons will increase up to the value $V_0$ for the last passing electron. Thanks to this difference in accelerating voltage applied to the various electrons, at the end or a drift space or adequate length, a significantly improved grouping or the bunch or electrons is obtained. Thus, in the numerical example given above ($f_0$=62.5 MHz; duration or the electron bunch at the anode or about 1 ns), assuming that the voltage $V_0$=80 kV and the drift length is or about 1 m, the duration or the electron bunch is reduced to about 100 ps. This result can be further improved by the addition or bunching cavities inserted at the end or the drift space, which allows to obtain pulses (bunch duration) or about 10 ps. The phase shirt or the voltage $VF_b$ with respect to the voltage $VF_0$ is easily obtained by means or the phase adjusting means 26 and 31 (FIG. 2).

In the example which has been described with reference to FIG. 1, a branch line with a length $\lambda g_1/4$ has been provided to have the cavity I resonate at two different frequencies. But it is clear that it is possible to use any other known equivalent means disposed according to the selected frequency ratios.

Thanks to the use or coaxial cavities and or radio frequency power supplies, there is obtained, with a simple implementation, an electron gun in which the modulation problems associated with the use of short gating DO voltage pulses (under one nanosecond) are eliminated.

It will be appreciated that the examplary embodiments described here are in no way limitative or the present invention.

What is claimed is:

1. An electron gun to provide electrons grouped in short pulses with a predetermined pulse repetition frequency $f_0$, said electron gun comprising:

a triode structure made up of an electron-emitting cathode K, a grid G and an anode A, comprising;

first means to generate a radio-frequency first voltage difference between the cathode and the grid from at least one radio-frequency wave of frequency at least equal to said pulse repetition frequency $f_0$, wherein all current in the cathode is generated by said radio-frequency first voltage, and second means to generate a radio-frequency second voltage difference between the grid and the anode from a first radio-frequency wave of frequency $F_0=k_0f_0$, wherein $k_0$ is an integer equal to or greater than 1.

2. An electron gun according to claim 1, wherein said first voltage is generated from the beating of a second and a third radio-frequency waves of respective frequencies $F_1=k_1f_0$ and $F_2=k_2f_0$, where $k_1$ and $k_2$ are integers such that $k_2=pk_1$, with p being an integer greater than 1, and $k_1$ being equal to or greater than 1.

3. An electron gun to provide electrons grouped in short pulses with a predetermined pulse repetition frequency $f_0$, said electron gun comprising:

a triode structure made up of an electron-emitting cathode K, a grid G, and an anode A, comprising:

first means to generate a radio-frequency first voltage difference between the cathode and the grid from at least one radio-frequency wave of frequency at least equal to said pulse repetition frequency $f_0$;

second means to generate a radio-frequency second voltage difference between the grid and the anode from a first radio-frequency wave of frequency $F_0=k_0f_0$, where $k_0$ is an integer equal to or greater than 1;

wherein said first voltage difference is generated from the beating of a second radio-frequency wave with a third radio-frequency wave whose respective frequencies are $F_1=k_1f_0$ and $F_2=k_2f_0$, wherein $k_1$ and $k_2$ are integers such that $k2=pk_1$, with p being an integer greater than 1, and $k_1$ being equal to or greater than 1; and wherein said first means comprises a first coaxial cavity resonator having a central conductor one end of which is terminated by a short-circuit and whose other end is terminated by said grid, said cathode disposed at the end of said central conductor facing said grid to form which it a first capacitance terminating said first cavity resonator, and wherein the characteristics of said first coaxial cavity resonator are selected so that it resonates at said second frequency $F_1$ further comprising a third means disposed on said first cavity resonator, for resonating at said third frequency $F_2$, said first cavity resonator comprising two excitation inputs fed respectively by the two radio-frequency waves at the frequencies $F_1$ and $F_2$.

4. An electron gun according to claim 3, wherein said third means comprises a coaxial branch line terminated by a short-circuit disposed so that the length of said branch line is equal to $(2q+1)\lambda g_1/4$, where $\lambda g_1$ is the wavelength corresponding to said second frequency $f_1$, and where q is an integer equal to or greater than 0.

5. An electron gun according to claim 3, wherein said first means comprises fourth means for generating a radio-frequency wave at said second frequency $F_1$ and a radio-frequency wave at said third frequency $F_2$, and for applying them to said excitation inputs with predetermined phases and amplitudes.

6. An electron gun according to claim 5, wherein said fourth means comprises:

a radio-frequency oscillator source;

two power supply channels respectively connected to said excitation inputs of the first cavity resonator and each including an amplitude adjusting device, a phase adjusting device and an amplifying device, as well as a frequency multiplier in at least one of said channels; and at least one coupler to connect the output of said radio-frequency oscillator source to said two power supply channels.

7. An electron gun according to any one of claims 3–6, wherein said second means comprises a coaxial cavity resonator having a central conductor one end of which is terminated by a short-circuit and whose other end is terminated by said grid, said anode being formed by the end of said central conductor facing said grid to form with it a second capacitance GA terminating said second cavity resonator, and said central conductor being formed by a hollow cylinder whose inner space allows the passage of the electrons emitted along the axis of said first and second cavity resonators, wherein a focusing solenoid surrounds said second cavity resonator over the length of said central conductor to form a drift space within the latter, and wherein the characteristics of said second coaxial cavity resonator and said grid-anode capacitance GA are selected so that said cavity resonates at said frequency $F_0$, said second cavity including an excitation input fed by said first radio-frequency wave.

8. An electron gun according to claim 7, wherein said second means comprise in addition fifth means to generate said first radio-frequency wave at said frequency $F_0$ and to apply it to said excitation input of the second cavity resonator with a predetermined phase and amplitude.

9. An electron gun according to claim 8, wherein said fifth means comprises:

a radio-frequency oscillator source; and a power supply channel connecting said oscillator source to said excitation input through an amplitude adjusting device, and an amplifying device.

10. An electron gun according to claim 1, wherein said second means comprises a drift space, and further comprising;

a bunching cavity resonator disposed along an electron drift direction of said drift space.

11. An electron gun according to claim 6, wherein said phase adjusting devices are adjusted so that said second and third radio-frequency waves are in phase, and so that the phase of the resulting beat wave is phase-shifted with respect to said first radio-frequency wave by a quantity such that said second voltage is increasing during passage of the electrons of a pulse through said anode.

12. A device according to claim 9, wherein said fifth means further comprises:

a phase adjusting device for adjusting the phase of a signal supplied by said power supply channel.

13. An electron gun in which all applied voltages are above 20 kilohertz for providing electrons grouped in short pulses with a predetermined pulse repetition frequency $f_0$, said gun comprising:

a triode structure made of an electron-emitting cathode K, a grid G and an anode A, comprising:

first means to generate a radio-frequency first voltage difference between the cathode and the grid from at least one radio-frequency wave of frequency at least equal to said pulse repetition frequency $f_0$; and second means to generate a radio-frequency second voltage difference between the grid and the anode from a first radio-frequency wave of frequency $F_0=k_0f_0$, where $k_0$ is an integer equal to or greater than 1.

14. An electron gun for providing electrons grouped in short pulses with a predetermined pulse repetition frequency $f_0$, said electron gun comprising:

a triode structure comprising an electron-emitting cathode K, a grid G, and an anode A and voltage application means for applying only voltages greater than 20 kilohertz to the triode, wherein said voltage application means applies to said triode all voltages necessary for operation of the triode, said voltage applying means comprising:

first means to generate a radio-frequency first voltage difference between the cathode and the grid from at least one radio-frequency wave of frequency at least equal to said pulse repetition frequency $f_0$; and second means to generate a radio-frequency second voltage difference between the grid and the anode from a first radio-frequency wave of frequency $F_0=k_0f_0$, where $k_0$ is an integer equal to or greater than 1.

15. An electron gun to provide electrons grouped in short pulses with a predetermined pulse repetition frequency $f_0$, said electron gun comprising:

a triode structure made up of an electron-emitting cathode K, a grid G and an anode A, comprising;

first means to generate a radio-frequency first voltage difference between the cathode and the grid from at least one radio-frequency wave of frequency at least equal to said pulse repetition frequency $f_0$, wherein all voltage between the cathode and the grid is due to said radio-frequency first voltage, and second means to generate a radio-frequency second voltage difference between the grid and the anode from a first radio-frequency wave of frequency $F_0=k_0f_0$, wherein $k_0$ is an integer equal to or greater than 1.

16. An electron gun according to claim 15, wherein said first voltage is generated from the beating of a second and a third radio-frequency waves of respective frequencies $F_1=k_1f_0$ and $F_2=k_2f_0$, where $k_1$ and $k_2$ are integers such that $k_2=pk_1$, with p being an integer greater than 1, and $k_1$ being equal to or greater than 1.

17. An electron gun according to claim 15, wherein said second means comprises a drift space, and further comprising;

a bunching cavity resonator disposed along an electron drift direction of said drift space.

* * * * *